United States Patent [19]

Sekiya et al.

[11] Patent Number: 4,617,766

[45] **Date of Patent: * Oct. 21, 1986**

[54] GRINDING WHEEL FOR FLAT PLATES

[75] Inventors: Shinji Sekiya, Tokyo; Takatoshi Ono, Nagareyama, both of Japan

[73] Assignee: Disco Co., Ltd., Tokyo, Japan

[ * ] Notice: The portion of the term of this patent subsequent to Oct. 25, 2000 has been disclaimed.

[21] Appl. No.: 749,043

[22] Filed: Jun. 26, 1985

Related U.S. Application Data

[63] Continuation of Ser. No. 523,825, Aug. 15, 1983, Pat. No. 4,545,154, which is a continuation of Ser. No. 212,305, Dec. 3, 1980, Pat. No. 4,411,107.

[30] Foreign Application Priority Data

Feb. 1, 1980 [JP] Japan ..... 55-10888
Feb. 1, 1980 [JP] Japan ..... 55-10889

[51] Int. Cl.[4] ..... B24D 5/00
[52] U.S. Cl. ..... 51/209 R; 51/267
[58] Field of Search ..... 51/206 R, 206 P, 206.4, 51/206.5, 207, 209 R, 209 DL, 209 S, 267, 295, 309, 359, 379, 382; 125/3, 4

[56] References Cited

U.S. PATENT DOCUMENTS

| | | | |
|---|---|---|---|
| 1,603,374 | 10/1926 | Bart | 51/DIG. 34 X |
| 1,954,330 | 4/1934 | Schurr | 51/209 R |
| 2,455,597 | 12/1948 | Metzger et al. | 51/209 R |
| 3,088,254 | 5/1963 | Lipkins | 51/209 R X |
| 3,290,834 | 12/1966 | Lindblad | 51/209 R X |
| 4,079,552 | 3/1978 | Fletcher | 51/309 X |
| 4,411,107 | 10/1983 | Sekiya et al. | 51/209 R |

FOREIGN PATENT DOCUMENTS

| | | | |
|---|---|---|---|
| 950863 | 10/1949 | France | 51/209 R |
| 150088 | 12/1975 | Japan . | |
| 1215064 | 12/1970 | United Kingdom | 51/267 |

*Primary Examiner*—Robert P. Olszewski
*Attorney, Agent, or Firm*—Flynn, Thiel, Boutell & Tanis

[57] ABSTRACT

A grinding wheel that can rotate at high speed to grind flat plates is comprised of a thin conical grindstone fastened to the open end of a rotatable inverted cup, with the grinding edge projecting outwardly from and at an inclined angle with respect to the open end. The grindstone includes a cylindrical fitting part which is fastened to the inside of the cup and a conical grinding part formed by electroplating from a nickel plating solution in which super hard abrasive grains are dispersed. The grindstone can also be prepared by electrodepositing abrasive grains directly onto a flange formed at the open end of the cup.

7 Claims, 14 Drawing Figures

GRINDING WHEEL FOR FLAT PLATES

This is a continuation, of application Ser. No. 523 825 filed Aug. 15, 1983, (now U.S. Pat. No. 4,545,154), continuation of Ser. No. 212 305 filed Dec. 3, 1980, (now U.S. Pat. No. 4 411 107).

BACKGROUND OF THE INVENTION

The present invention relates to an extremely thin grinding wheel coated with super abrasive grains such as diamond grains and cubic system boron nitride, and to a process for producing the same.

Heretofore, grinding of flat surfaces of a hard, brittle workpiece (1) like silicon and glass has been accomplished by the use of a ring grindstone (2) attached to the open end of an inverted revolving cup (3) as shown in FIG. 1. The use of such conventional grindstone (2) involves many problems. The side and bottom of the grindstone crossing at right angles provides a large area in contact with the workpiece (1), thereby generating a large amount of friction heat and impairing the dimensional accuracy of the work due to thermal expansion. Moreover, loading of pores with chips is likely to occur, resulting in dulling, burn marks, and grinding cracks. In addition, the cutting edge of the grindstone (2) becomes dull during grinding, causing the grindstone to escape from the work. This makes it difficult to grind the work with one pass, and makes it necessary to repeat the grinding bit by bit in order to grind the work to a desired thickness. This is very inefficient. In another type of conventional grindstone, the bottom is tapered inwardly as shown in FIG. 2. This grindstone still has a large contact area and is easy to lose sharpness, masking it necessary to regenerate the taper.

BRIEF SUMMARY OF THE INVENTION

It is an object of this invention to provide a grinding wheel capable of grinding a hard, brittle flat plate to a prescribed thickness with a neat finish.

It is another object of this invention to provide a process to produce the grinding wheel as set forth for the first object. According to this process, the grinding wheel is produced by fastening to the open end of a cup a grindstone formed by electrodeposition of abrasive grains of super hard crystalline materials such as diamond or cubic system boron nitride from a nickel plating solution containing dispersed grains. In another production process, the grindstone is formed directly onto the open end of the cup by electrodeposition.

The other objects and advantages of this invention will be apparent from the description that follows:

BRIEF DESCRIPTION OF THE INVENTION

DETAILED DESCRIPTION OF THE INVENTION

According to the first example of this invention, the grinding wheel (5) is produced by fastening a thin grindstone (4) to a cup (3), both being produced separately. We will describe at first the process for producing the thin grindstone (4).

Figure 1:
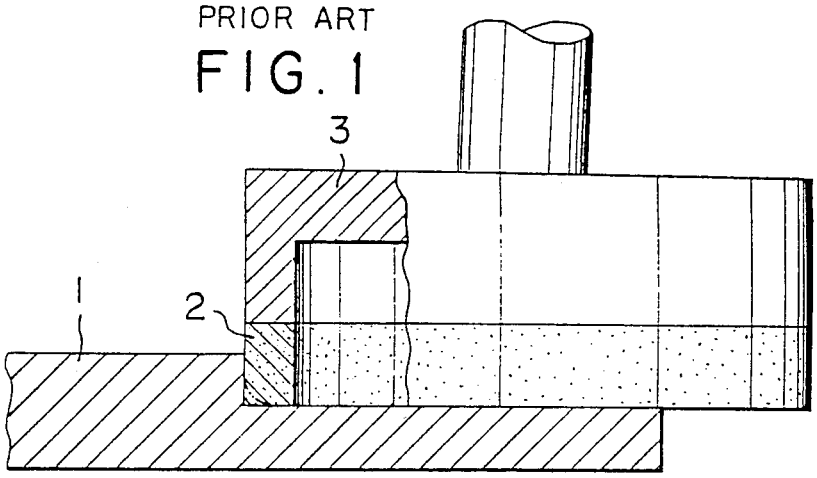
PRIOR ART FIG. 1
FIG. 1 is a partially cutaway view of a conventional grinding wheel.
Figure 2:
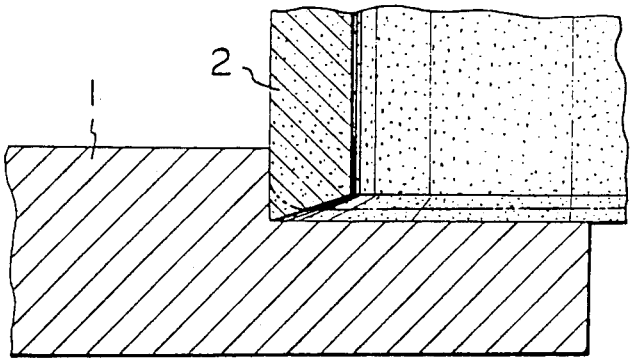
PRIOR ART FIG. 2
FIG. 2 is a sectional view of another conventional grinding wheel.
Figure 3:
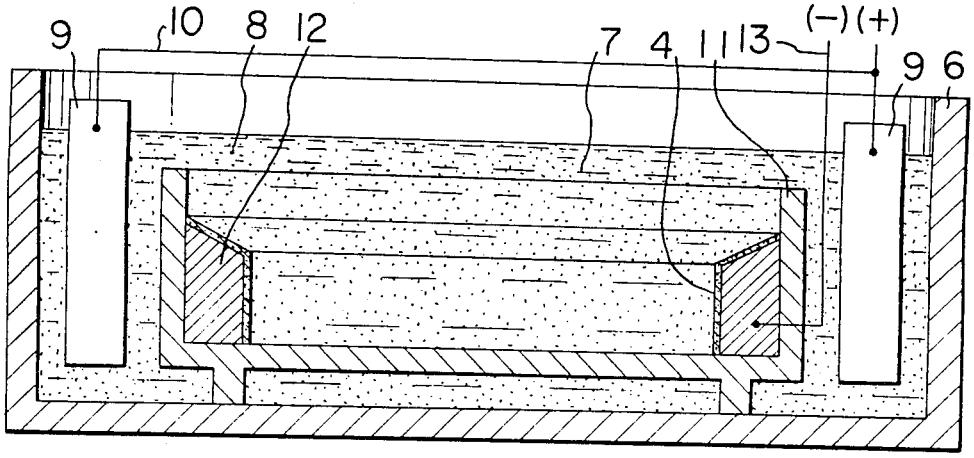
FIG. 3 is a sectional view of the electroplating apparatus for making the grinding wheel of this invention.

The grindstone is produced by normal electroplating using an apparatus as shown in FIG. 3, wherein a container for the plating bath is made of polyvinyl chloride and it contains nickel plating solution (7), in which are dispersed abrasive grains (8) of super hard crystalline materials such as diamond or cubic system boron nitride. In the plating solution (7) are immersed the nickel plates (9) which are connected to act as anodes through the lead wire (10). The nickel plates (9) are enclosed in a thick bag of synthetic fibers in order to prevent impurities and fine particles from dropping off or entering the nickel solution (7). Within the space between the nickel plates (9) there is installed a cylindrical insulating body (11) which has a closed bottom and is made of polyvinyl chloride or metal coated with special insulating films. A cathode plate (12) having the pattern of the grindstone (4) to be produced is removably fitted in the insulating body (9). This cathode plate (12) is made by completely lapping with #600–#1000 abrasive grains a special alloy which is free from internal stress and permits the electrodeposit to be peeled off easily. To facilitate peeling, a release agent may be applied. The cathode plate (12) is connected as a cathode with a completely insulated lead wire (13).

Using the above-mentioned apparatus, the grinding wheel (5) of this invention is produced according to the following procedure.

(1) Make adjustments as follows according to the grindstone (4) to be produced.

COMPOSITION OF PLATING SOLUTION

Nickel sulfate ($NiSO_4.6H_2O$): 220–370 g/L
Nickel chloride ($NiCl_2.6H_2O$): 30–60 g/L
Boric acid ($H_3BO_3$): 30–60 g/L
Brightening agent: 5–20 ml/L
Temperature of plating solution: 30°–70° C.
pH of plating solution: pH 3–5
Quantity of abrasive grains: 5–40 g per 1 L of plating solution
Grading of abrasive grains: #400–#40
Kind of abrasive grains: Artificial diamond, Natural diamond, or cubic system boron nitride (2) Degrease and clean the surface of the cathode plate (12), and rinse it with distilled water. After applying a release agent, tightly fit and fasten the cathode plate (12) inside the insulating body (11).

(3) Stir the plating solution (7) to disperse the abrasive grains (8) completely.

(4) Immerse the insulating body (11) with the treated cathode plate (12) fitted therein in the plating solution (7).

(5) Connect the lead wire (13) of the cathode plate (12) to the terminal of a rectifier, and increase the current to a prescribed amperage gradually.

(6) Move the insulating body (11) up and down at proper time intervals (e.g., 5 to 30 minutes) according to the grading of abrasive grains, so that the abrasive grains (8) which have deposited on the cathode plate (12) are shaken off, and at the same time, the plating solution (7) is stirred and the abrasive grains (8) are dispersed.

(7) Repeat the step 6 for a prescribed period of time according to the thickness of the grindstone (4) to be produced.

(8) Turn off the power source for the rectifier. Take out the cathode plate (12). After washing with water and drying, observe the surface of the grindstone (4) with a microscope. Any projections caused by foreign matters should be removed completely by lapping with a dresser of #600–#800.

(9) Demold the grindstone (4) from the cathode plate (12).

The grindstone (4) thus produced has a cylindrical shape with an expanding conical part which forms the grinding part (14). The grinding part (14) is 0.1 to 0.5 mm thick and about 5 mm wide, and its lower side (15) is inclined at an angle of 10° to 45° with respect to the grinding surface (16), or the angle ($\theta$) held between the vertical fitting part (17) and the grinding part (14) is 100° to 135° so that the lower side (15) of the grindstone (4) does not come into contact with the grinding surface (16) of the work (1). Thus, the cutting edge (18) comes into contact with the grinding surface (16) of the work (1) with a minimum of area.

The cup (3) is molded previously in such a shape that the fitting part (17) of the grindstone (4) comes into close contact with the inside of the cup (3) and the grinding part (14) of the grindstone (4) projects outward.

Figure 4:
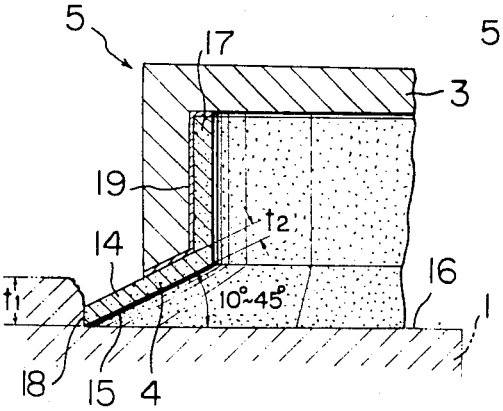
FIG. 4 is a sectional view illustrating how the grindstone is fastened to the open end of the cup.

The grindstone (4) produced by the above process is firmly fastened to the cup (3) to produce the grinding wheel (5) by bonding, with an adhesive (19), the fitting part (17) of the grindstone (4) to the inside of the cup (3) as shown in FIG. 4. The adhesive (19) may be an epoxy adhesive or low temperature solder capable of bonding metals.

The grinding wheel (5) thus constructed accomplishes grinding based on the principle of cutting. The grindstone (4) is rotated at high speed together with the cup (3), and the grinding wheel (5) or the work (1) is moved. The relative position of the cutting edge (18) of the grindstone (4) is so adjusted that the grinding thickness ($t_1$) is 0.3 to 0.8 mm, several times the thickness ($t_2$) of the grindstone (4). Grinding is started with the cutting edge (18) in contact with the side of the work (1), and then the grinding wheel (5) or the work (1) is moved at a predetermined speed. It should be noted that grinding is accomplished in such a manner that only the cutting edge (18) of the grinding wheel (5) is in contact with the surface (16) being ground and the undercut portion of the work (1) above the surface (16) disrupts by itself due to its brittleness. In other words, the portion of the work above the grinding surface (16) is not actually ground, but becomes broken by itself, and the surface (16) is ground neatly by the grinding wheel (5). Thus, coarse chips and a small quantity of fine powder are given off as the result of the grinding.

Figure 6:
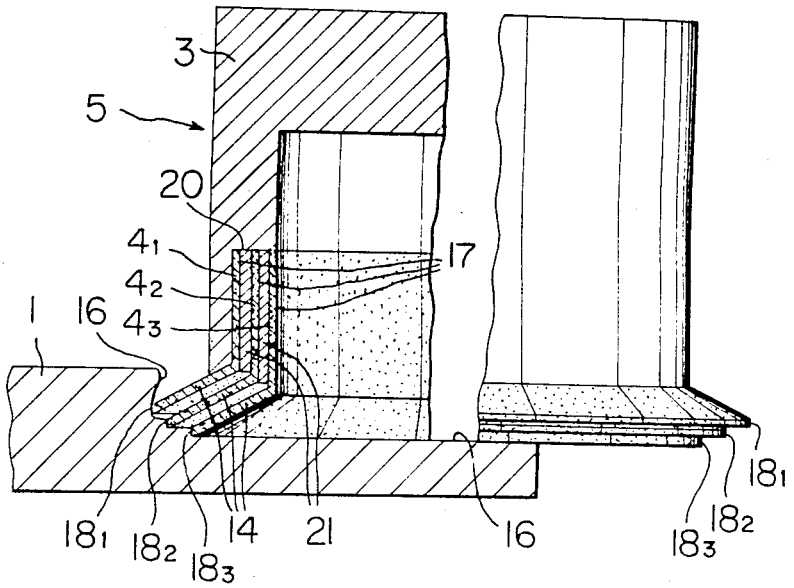
FIG. 6 is a sectional view of a grinding wheel of this invention in which a multiplicity of grindstones are placed one over another.

FIG. 6 shows another embodiment to grind the work (1) to a greater depth with a single psss. In this embodiment, the grinding wheel (5) has three grindstones ($4_1$), ($4_2$), and ($4_3$) of slightly different diameters. The fitting part (17) of the grindstone ($4_1$) having the largest diameter is fastened to the stepped part (20) inside the cup (3). The grindstone ($4_2$) of the middle diameter is fastened through at first spacer (21) to the inside of the fitting part (17). Finally, the grindstone ($4_3$) of the smallest diameter is fastened through a second spacer (21) in the same manner. Thus the grinding part (14) is arranged in three layers and the cutting edges ($18_1$), ($18_2$), and ($18_3$) having different diameters are arranged at certain intervals.

With the construction mentioned as above, grinding of the work (1) to a greater depth can be accomplished with a single pass because those portions which are undercut by the cutting edges ($18_1$), ($18_2$), and ($18_3$) of the respective grindstones ($4_1$), ($4_2$), and ($4_3$) break by themselves as mentioned above.

Figure 5:
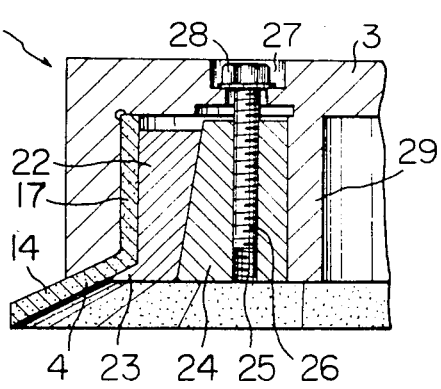
FIG. 5 is a sectional view illustrating a different way of fastening the grindstone to the open end of the cup.

FIG. 5 shows another embodiment of this invention in which the grinding wheel (5) is formed by fixing, without any adhesive, the grindstone (4) to the cup (3) with the separate pressing member (22). The pressing member (22) is a ring having an outside diameter equal to the inside diameter of the grindstone (4), and having an engaging projection (23) on its peripheral edge. The pressing member (22) has a tapered inside wall with slits (not shown) that permit the pressing member (22) to expand. A tightening member (24) is provided in contact with the tapered surface of the pressing member (22). The tightening member (24) has several threaded through-holes (25) into which bolts (26) are screwed. The bolts (26) are inserted through the washers (28) from the bolt holes (27) formed on the top of the cup (3). The inside of the tightening member (24) is in contact with the internal peripheral plate (29) projecting downwardly from the bottom of the cup (3).

In the above-mentioned construction, the grinding wheel (5) is formed by fastening the grindstone (4) to the cup (3) in the following way. Fit the grindstone (4) to the cup (3). Fit the pressing member (22) and then the tightening member (24). Screw the bolt (26) into the threaded hole (25) through the washer (28) from above the bolt hole (27). Tighten the bolt (26) to move the tightening member (24) upwardly, causing the pressing member (22) to expand. Now the fitting part (17) of the grindstone (4) is held firmly between the pressing member (22) and the cup (3). This arrangement permits the replacement of a worn grindstone (4).

Figure 7:
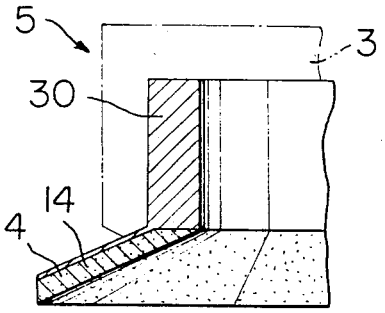
FIGS. 7 and 8 are sectional views of the grinding wheel of this invention in which the grindstone is formed by electroplating directly on the flange formed at the open end of the cup.
Figure 8:
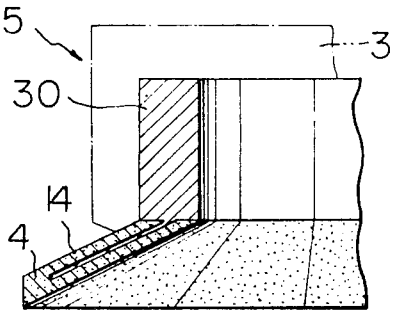

FIGS. 7 and 8 show additional embodiments of this invention in which the grindstone (4) is formed directly onto the base metal (30) which is used as the fitting part (17). In FIG. 7 the base metal (30) forms the thick fitting part (17) and the grinding part (14) consists of the grindstone (4) formed on a thin part of the base metal (30). The base metal (3) is preferably a soft metal which retains electrodeposits and has no deteriorating effect on grinding.

Figure 9:
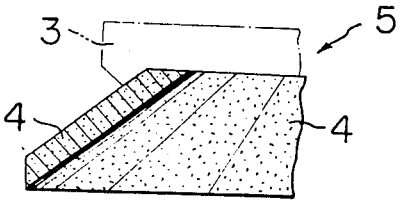
FIGS. 9 and 10 are sectional views of other grinding wheels of this invention.
Figure 10:
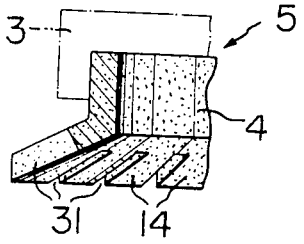
Figure 14:
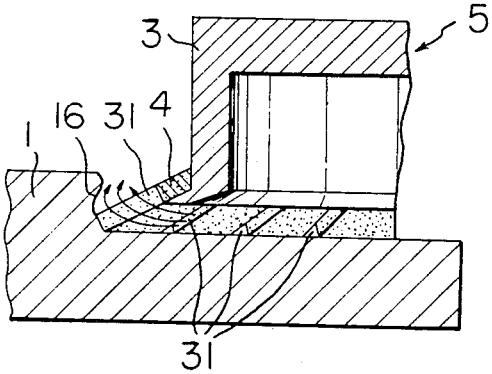
FIG. 14 is a partially sectional view showing another grinding wheel of this invention in a position for grinding the work.

FIGS. 9 and 10 show additional embodiments having grindstones (4) of different shape. The grindstone (4) shown in FIG. 9 increases gradually in diameter from top to bottom. The grindstone (4) shown in FIG. 10 is provided with slots (31) at equal intervals through which cooling water injected into the inside of the grindstone is discharged together with chips. The cooling water injected from the inside of the grindstone (4) is ejected to the grinding surface (16) through the slots (31) as shown in FIG. 14, whereby chips are removed and the work (1) and the grindstone (4) are cooled. The thinner the slots (31), the more effective is the action. But the depth, width, and number of the slots should be determined according to the object required to retain the necessary strength of the grindstone.

Figure 11:
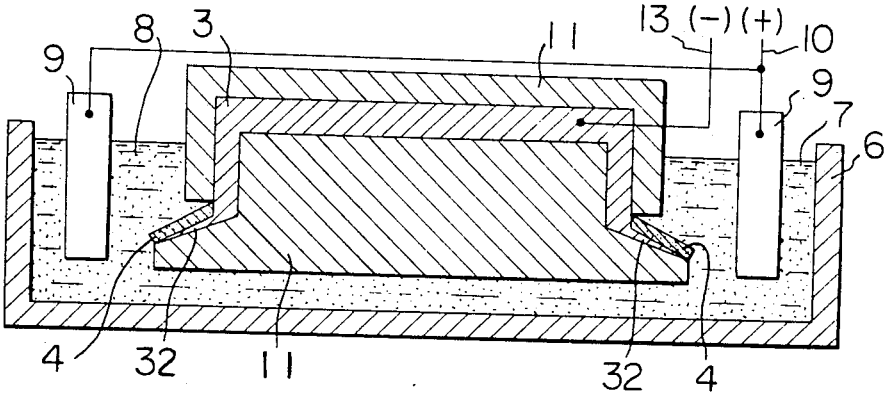
FIG. 11 is a sectional view of an electroplating apparatus for making the grinding wheel of this invention.

In a second method of this invention, the grindstone (4) is formed by electroplating directly onto the flange (32) formed at the open end of the cup (3) as shown in FIG. 11, wherein the container for the plating bath (6) is made of polyvinyl chloride and like and is filled with the plating solution (7) containing abrasive grains (8) as in FIG. 3. In the plating solution (7) are immersed the nickel plates (9) which are connected as the anode (+) through the lead wire (10). The nickel plates (9) are enclosed in a thick bag of synthetic fibers to prevent impurities and particles from dropping off and entering the plating solution (7). In the space between the nickel plates (9) is placed the cup (3) onto which the grindstone (4) is directly formed. The cup has a tapering open end extending outward at a certain angle on which is formed the part (32) for electrodepositing the grindstone. The width and angle of the part (32) is determined according to the use of the grinding wheel. The part (32) is coated entirely with an insulating material (11) except the surface on which the plated layer is formed so that the cup (3) does not come into contact with the plating solution (7). The cup (3) is connected to the completely insulated lead wire (13) which is further connected as the cathode (−). The electrodeposition of the grindstone (4) on the part (32) is performed by almost the same procedure as described for FIG. 3.

Figure 12:
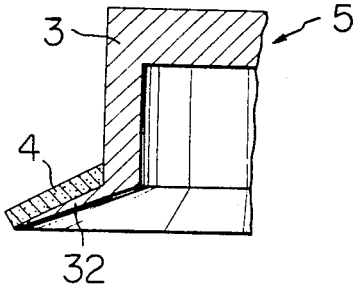
FIG. 12 is a partially sectional view showing abrasive grains electrodeposited on the open end of the cup.
Figure 13:
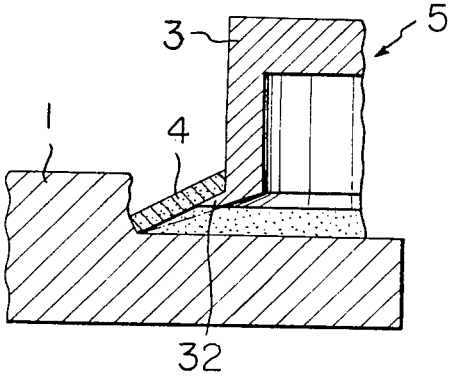
FIG. 13 is a partially sectional view showing the grinding wheel of this invention in a position for grinding the work.

After the grindstone (4) has been formed on the part (32) as shown in FIG. 12, the end of the part (32) is removed as shown in FIG. 13 so that the grindstone alone (4) comes in contact with the work (1) when the grinding wheel (5) is at work.

In the above-mentioned embodiments, the grindstone (4) is formed on the upper surface of the part (32), but the grindstone (4) may be formed on the lower surface of the part (32).

FIG. 14 shows another embodiment in which the grindstone (4) is provided at certain intervals with slots (31) as passage for cooling water and chips. The process for electrodeposition is performed in the same manner as in the above-mentioned embodiments and the function is the same as mentioned for FIG. 10.

What we claim is:

1. A grinding wheel comprising a cup and at least one grindstone provided at an open end of said cup, said grindstone having means for grinding a flat surface of a hard and brittle workpiece in a cutting manner, said means being an annular grinding portion which protrudes radially outwardly from the open end of said cup with inclination relative to the central axis of said cup, a substantial fraction of the width of said grindstone being cantilevered out from said cup, such that the radially inner and outer portions of the width of said grindstone are respectively backed by and free of backing by said cup, means for simultaneously minimizing risk of breakage of the grinding portion and overheating of said hard and brittle material being ground, said means comprising (1) a grindstone composition of electrodeposited super hard abrasive grains with at least said radially outer portion of the width of said grindstone not including any substrate or other backing and (2) a grinding portion thickness in the range of 0.1 to about 0.5 mm, whereby said grinding portion is sufficiently thin to grind the flat surface in a cutting manner efficiently and accurately.

2. The grinding wheel of claim 1 wherein the thickness of said grinding portion is substantially uniform.

3. The grinding wheel of claim 1 wherein said super hard abrasive grains are diamond abrasive grains.

4. The grinding wheel of claim 1 wherein the angle ($\theta$) between said grinding portion and said central axis is at least 100°.

5. The grinding wheel of claim 1 wherein a plurality of slots are formed at circumferentially spaced positions in said grinding portion.

6. The grinding wheel of claim 1 in which the downward facing open end of said cup has an annular surface inclined in conformance to the inclination of said grindstone.

7. A grinding wheel for grinding a flat surface of a hard and brittle materia, comprising:

a cup rotatable about an axis substantially perpendicular to the flat surface to be ground and having a downward facing open end; and an annular grindstone, said grindstone having means for grinding said flat surface of said hard and brittle workpiece in a cutting manner, said means being a thin open-center conical skirt, said grindstone protruding downwardly and radially outwardly away from the open end of said cup at an inclination to said axis, the downward facing open end of said cup having an annular surface shaped in conformance to the radially inner part of the width of said grindstone and to which only the radially inner part of the width surface of the grindstone is affixed to fixedly depend the grindstone from the open end of the cup, the thickness of the grindstone being substantially less than its width along its inclination and than its circumference, a substantial portion of the inclined width of said grindstone being cantilevered out from said cup, such that the radially inner and outer portions of the width of grindstone are respectively backed by and free of backing by said cup, said grinding wheel being positioned so that the outer peripheral edge of said grindstone interferes with the flat surface to be ground means for simultaneously minimizing risk of breaking of the grinding portion and overheating of said hard and brittle material being ground, said means comprising (1) a grindstone composition of electrodeposited super hard abrasive grains with at least said radially outer portion of the width of said grindstone not including any substate or other backing and (2) a grinding portion thickness in the range of 0.1 to about 0.5 mm;

shaft means for rotating the cup and grindstone and for relatively moving the hard and brittle material and said grindstone in a direction substantially parallel to the flat surface to be ground, to grind the flat surface in a cutting manner.

* * * * *